US006425539B1

(12) United States Patent
Boecking

(10) Patent No.: US 6,425,539 B1
(45) Date of Patent: Jul. 30, 2002

(54) CONTROL UNIT FOR CONTROLLING THE PRESSURE BUILDUP IN A PUMP UNIT

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/529,656

(22) PCT Filed: Aug. 17, 1999

(86) PCT No.: PCT/DE99/02544

§ 371 (c)(1),
(2), (4) Date: Jun. 5, 2000

(87) PCT Pub. No.: WO00/11339

PCT Pub. Date: Mar. 2, 2000

(30) Foreign Application Priority Data

Aug. 18, 1998 (DE) ..... 198 37 332

(51) Int. Cl.[7] ..... F02M 61/00

(52) U.S. Cl. ..... 239/533.12; 239/533.4; 239/584; 239/585.1

(58) Field of Search ..... 239/533.3, 533.4, 239/533.5, 533.9, 533.12, 88–93, 95, 537, 541, 583, 584, 585.1, 585.4, 585.5; 137/630.14, 630.15, 630.22

(56) References Cited

U.S. PATENT DOCUMENTS 1,663,472 A * 3/1928 Salis
4,339,080 A * 7/1982 Kopse
5,226,452 A * 7/1993 Muller et al.
5,301,714 A * 4/1994 Johnson

* cited by examiner

*Primary Examiner*—William C. Doerrler
*Assistant Examiner*—Christopher Kim
(74) *Attorney, Agent, or Firm*—Ronald E. Greigg

(57) ABSTRACT

A control unit for controlling a pressure buildup by a pump unit in a fuel injection system. The control unit has a control valve and a valve actuation unit connected to the control valve. The control valve is embodied as an inlet valve that opens inward in the flow direction. The control unit has a valve body that is supported so that the valve body moves axially in a housing of the control unit and rests against a valve seat of the control valve from the inside when the control valve is closed. In order to give the through flow curve of the control valve as flat a course as possible with small strokes ($S_{small}$) of the control valve. The control unit includes a throttle device that throttles the flow through the control valve when the control valve is open by a small stroke ($S_{small}$).

5 Claims, 2 Drawing Sheets

CONTROL UNIT FOR CONTROLLING THE PRESSURE BUILDUP IN A PUMP UNIT

The current invention relates to a control unit for controlling a pressure buildup by a pump unit in a system, wherein the control unit has a control valve and a valve actuation unit connected to the control unit and the control valve is embodied as an inlet that opens in the inlet flow direction, which has a valve body that is supported so that the valve body can move axially in a housing of the control unit and rests against a valve seat of the control valve from the inside when the control valve is closed.

The current invention also relates to an injection system for fuel delivery into a combustion chamber of direct injection internal combustion engines, with a pump unit for building up an injection pressure and then for injecting the fuel into the combustion chamber via a fuel injector.

Finally, the current invention also relates to a process for controlling the pressure buildup by means of a control unit with a control valve and a valve actuation unit connected to the control unit, wherein the control valve is embodied as an inlet valve which opens in the inlet flow direction and has a valve body that is supported so that the valve body can move axially in a housing and rests against a valve seat of the control valve when the control valve is closed.

PRIOR ART

Control units of this kind for controlling the pressure buildup of arbitrary pump units have been disclosed by the prior art. For example, they are used to control the fuel delivery into a combustion chamber of direct injection internal combustion engines. The internal combustion engines have a pump unit for building up an injection pressure and then for injecting the fuel into the combustion chamber via a fuel injector. For example, the injection system of the internal combustion engine can be embodied as a unit injector system (UIS) or as a unit pump system (UPS).

These known control units are usually embodied as solenoid valves. In this connection, the valve actuation unit is embodied as an electromagnet that actuates the control valve. The solenoid valve is open when the valve is not excited. As a result, there is a free through flow from the pump unit to the low-pressure region of the injection system and it is consequently possible for there to be a filling of the pump chamber with fuel during the intake stroke of the pump piston and a return flow of the fuel during the delivery stroke. A triggering of the solenoid valve during the delivery stroke of the pump piston closes this bypass. This leads to a pressure increase in the high-pressure region of the system. Consequently, the pressure buildup in the pump unit can be controlled by means of the control unit.

The control valve is embodied as an inlet valve that opens in the inlet flow direction. Inlet valves usually have a very steep through flow curve with small strokes. In a through flow curve, the course of the through flow through a valve is plotted as a function of the stroke of the valve. Due to the steep course of the through flow curve that inlet valves have with small strokes, even slight fluctuations of the valve stroke lead to relatively large fluctuations in the through flow quantity. Fundamentally, a fluctuation of the through flow quantity with small strokes would have hardly any effect on the total quantity of the medium supplied. However, there are applications in which the through flow quantity through the valve with small valve strokes should be kept as independent of the valve stroke as possible and which must have as flat as possible a course of the through flow curve with small strokes.

For example, an application of this kind is the control of the fuel supply in direct injection internal combustion engines. In these engines, a so-called preinjection is frequently carried out, i.e. a small quantity of fuel is injected into the combustion chamber before the actual main injection. The noise behavior and exhaust behavior of the internal combustion engine can be positively influenced with the aid of the preinjection. One must be able to precisely determine the quantity of the preinjected fuel in order to be able to control the behavior of the internal combustion engine in a deliberate manner. The preinjection takes place with small strokes of the control valve. With the control unit according to the prior art, even slight fluctuations of the valve stroke have large effects on the quantity of the preinjected fuel. In order to be able to determine the preinjection quantity as precisely as possible, it would therefore be advantageous if the through flow curve had a flat course with small strokes.

In order to embody the course of the through flow curve with small strokes so that the flow curve is as flat as possible, the prior art has disclosed controlling the through flow quantity electronically. However, an electronic control is complex and expensive.

The above-mentioned disadvantages of the prior art give rise to an object of the current invention, which is to improve a control unit of the type mentioned at the beginning in such a way that the through flow curve has as flat a course as possible with small strokes of the control valve.

In order to attain this object, based on a control unit of the type mentioned at the beginning, a control unit which is characterized by means of a throttle device which throttles the through flow through the control valve when the control valve is open by a small stroke.

When the control valve of the control unit according to the invention is open by a large stroke, there is a free through flow from the pump unit, through the valve seat of the control valve, to a low-pressure region of a system in which the pressure buildup is intended to be controlled. Consequently, it is possible for there to be a filling of the pump chamber with the supplied medium during the intake stroke of the pump piston and a return flow of the medium during the delivery stroke. Therefore, no pressure is built up in the system.

By triggering the valve actuation unit, the valve piston is moved in the direction of the closed position of the control valve. In this manner, the control valve can be brought into a valve position that is open by a small stroke. When the control valve is open by a small stroke, there is still a through flow, but only a throttled through flow, from the pump unit, through the valve seat of the control valve and the throttle device, to the low-pressure region of the system. Consequently, it is possible for there to be a partial filling of the pump chamber with the supplied medium during the intake stroke of the pump piston and a return flow of the medium during the delivery stroke. A slight pressure is built up in the high-pressure region of the system.

Another triggering of the valve actuation unit during the delivery stroke of the pump piston closes the control valve completely, as a result of which the bypass from the pump unit to the low-pressure region of the system is shut off. This leads to the buildup of a high pressure in the high-pressure region of the system.

During the closing process from a maximal value when the control valve is completely open to the value zero when the control valve is completely closed, the through flow quantity of the medium flowing through the control valve does not decrease sharply. On the contrary, when a small stroke is achieved, a virtually constant small quantity of the supplied medium flows through the control valve until the control valve is completely closed. The course of the through flow curve of the control valve is advantageously very flat with small strokes. This achieves the fact that fluctuations of the valve stroke cause hardly any fluctuations of the through flow quantity. With small strokes, the through flow quantity is virtually independent of the valve stroke.

The throttle device is advantageously integrated into the valve body. This has the advantage that the throttle device does not have to be triggered separately, but, together with the valve body, can be brought from an inactive position when the control valve is completely open into an active position when the control valve is open by a small stroke.

According to an advantageous improvement of the invention, a second valve body is disposed on the valve body, on the outlet in the closing direction, and this second valve body is disposed in a closed position with small strokes of the control valve and has at least one throttle bore which communicates with an inlet and an outlet of the control valve when the control valve is open.

Preferably, the second valve body is supported so that the second valve body can move axially in the valve body. When the control valve is closed and with a small stroke of the control valve, the second valve body rests against a second valve seat of the control valve from the inlet in the flow direction. When the control valve is completely open, i.e. with a large stroke, the valve body of the control valve is lifted up from the valve seat and the second valve body of the throttle device is lifted up from the second valve seat. The supplied medium can freely flow through the valve seat and the second valve seat, from the pump unit to the low-pressure region of the system. When the control valve is partially open, i.e. with a small stroke, the valve body of the control valve is still lifted up from the valve seat, but the second valve body of the throttle device rests against the second valve seat. The supplied medium can only flow in a throttled fashion through the valve seat and the throttle bore of the second valve body. As a result, a slight pressure is built up in the system. When the control valve is completely closed, the valve body of the control valve rests against the valve seat and the supplied medium is stopped at the valve seat. Now a higher pressure is built up in the system.

When the control valve is closed or with a small stroke of the control valve, the second valve body is advantageously pressed against the second valve seat by means of a spring element that acts between the valve body and the second valve body.

Preferably, the second valve body has a stop which rests against the valve body when there is a large stroke of the control valve. When the control valve is closed, the distance between the stop and the valve body corresponds to the magnitude of the small valve stroke during which the throttle device is active.

Alternatively, the second valve body is embodied on the valve body, on the outlet in the flow direction, and that when the control valve is closed and when there is a small stroke of the control valve, the second valve body is received in a sealed fashion in a receiving bore from which the outlet of the control valve leads. The second valve body and the receiving bore constitute the second valve seat, which is closed during the small strokes of the control valve. When the control valve is completely open, i.e. with a large stroke, the valve body of the control valve is lifted up from the valve seat and the second valve body of the throttle device is disposed outside the receiving bore. The supplied medium can flow freely through the valve seat and the second valve seat, from the pump unit to the low-pressure region of the system. When the control valve is partially open, i.e. with a small stroke, the valve body of the control valve is still lifted up from the valve seat, but the second valve body of the throttle device is contained in a sealed fashion by the receiving bore. The supplied medium can only flow in a throttled fashion through the valve seat and the throttle bore of the second valve body. As a result, a slight pressure is built up in the system. When the control valve is completely closed, the valve body of the control valve rests against the valve seat and the supplied medium is stopped at the valve seat. Now a higher pressure is built up in the system.

The current invention also relates to an injection system for fuel delivery into a combustion chamber of direct injection internal combustion engines, with a pump unit for building up an injection pressure and then for injecting the fuel into the combustion chamber via a fuel injector, wherein the injection system has means for preinjecting a small quantity of fuel into the combustion chamber before the actual main injection.

In order to improve an injection system of this kind in such a way that the fuel quantity of the preinjection can be controlled in a particularly precise and reliable fashion, the invention proposes that the injection system have a control unit of the type mentioned above.

Finally, the current invention also relates to a process for controlling the pressure buildup by a pump unit in a system by means of a control unit, which has a control valve and a valve actuation unit connected to the control unit, wherein the control valve is embodied as an inlet valve that opens in the inlet flow direction, which has a valve body that is supported so that the valve body can move axially in a housing of the control unit and rests against a valve seat of the control valve from the inlet when the control valve is closed, and wherein in order to build up a pressure in the system, the valve body of the control valve is brought from a position that is open by a large stroke, through a position that is open by a small stroke, and into a closed position.

So that with small strokes of the control valve, the through flow curve has as flat a course as possible, the invention proposes that the through flow through the control valve be throttled by means of a throttle device from the time at which the valve body is open by a small stroke to the time at which the valve body is closed.

The process is advantageously used to control the fuel delivery into a combustion chamber of a direct injection internal combustion engine, with a pump unit for building up an injection pressure and then for injecting the fuel into the combustion chamber via a fuel injector. The advantages of the invention come into play particularly in such a use of the process according to the invention. Consequently with the process according to the invention, it is possible, for example, to control the fuel quantity of a preinjection in a particularly precise and reliable manner since the through flow quantity through the control valve is virtually independent of the valve stroke of the control valve due to the flat course of the through flow curve. Consequently, fluctuating small strokes only cause a slight fluctuation in the through flow quantity.

BRIEF DESCRIPTION OF THE DRAWINGS

A preferred exemplary embodiment of the invention will be explained in detail below in conjunction with the drawings.

DETAILED DESCRIPTION

Figure 1:
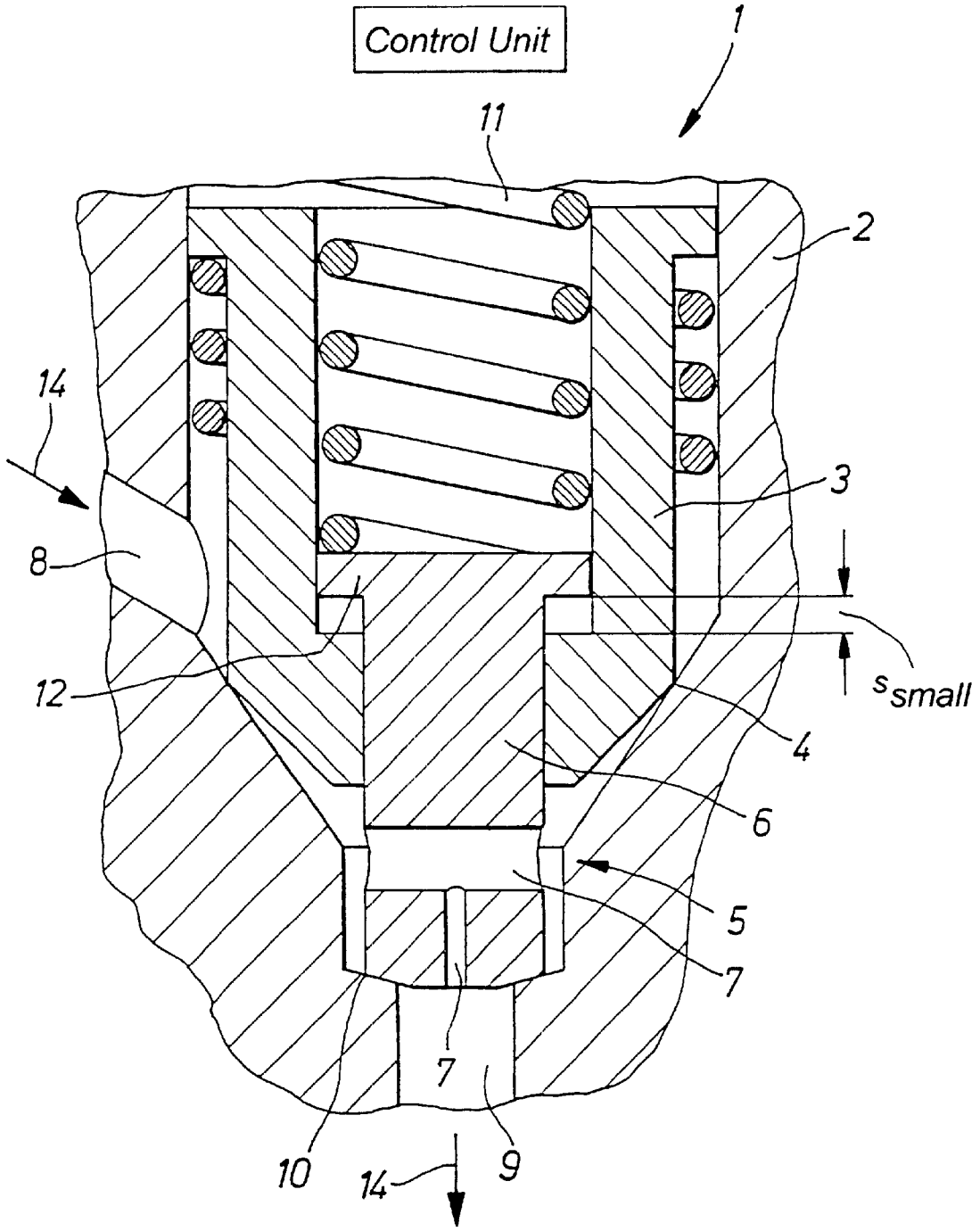
FIG. 1 is a sectional view of a control valve of a control unit according to the invention.

FIG. 1 shows a control valve 1 of a control unit according to the invention, in accordance with a first embodiment. The control unit is used to control the pressure buildup by a pump unit in an arbitrary system. This control unit has the control valve 1 and a valve actuation unit (not shown) connected to the control unit. The control valve 1 is embodied as an inlet valve that opens inward in the flow direction 14. It has a valve body 3 that is supported so that the valve body can move axially in a housing 2 of the control unit and rests against a valve seat 4 of the control valve 1 from the inlet when the control valve 1 is closed. The control valve 1 has a throttle device 5 which throttles the through flow through the control valve 1 when the control valve 1 is open by a small stroke.

The throttle device 5 is embodied as a second valve body 6 that is integrated into the valve body 3. The additional valve body 6 is disposed on the valve body 3, on the outlet of the flow direction. With a small stroke of the control valve 1, the second valve body 6 is disposed in a closed position and has two throttle bores 7 and 7' which communicate with an inlet 8 and an outlet 9 of the control valve 1 when the control valve 1 is open. The second valve body 6 is supported so that the second valve body can move axially in the valve body 3. When the control valve 1 is closed and with a small stroke of the control valve 1, the second valve body 6 rests against a second valve seat 10 of the control valve 1 from the inlet of the valve body 3.

When the control valve 1 is open by a large stroke, both the valve seat 4 and the second valve seat 10 are open. There is a free through flow from the pump unit to a low-pressure region of the system and consequently, it is possible for there to be a filling of the pump chamber with the supplied medium during an intake stroke of the pump piston and a return flow of the medium during the delivery stroke. No pressure is built up in the system.

When the control valve 1 is open by a small stroke, the valve seat 4 is in fact still open, but the second valve seat 10 is closed so that the supplied medium must flow through the control valve 1 by way of the throttle bores 7 and 7'. As a result of this throttled through flow through the control valve 1, a low pressure is built up in the high-pressure region of the system.

When the control valve 1 is completely closed, both the valve seat 4 and the second valve seat 10 are closed, by means of which the bypass is shut off. This leads to the buildup of a high pressure from the pump unit in the low-pressure region of the system.

When the control valve 1 is closed or with a small stroke of the control valve 1, a spring element 11, which acts between the valve body 3 and the second valve body 6, presses the second valve body 10 against the second valve seat 10. The second valve body 6 has a stop shoulder 12 which rests against the valve body 3 with a large stroke of the control valve 1. The second valve seat 10 is embodied as particularly flat so that with large strokes of the control valve 1, after the opening of the second valve seat 10, the high through flow value Q is achieved as rapidly as possible (see FIG. 3).

Figure 2:
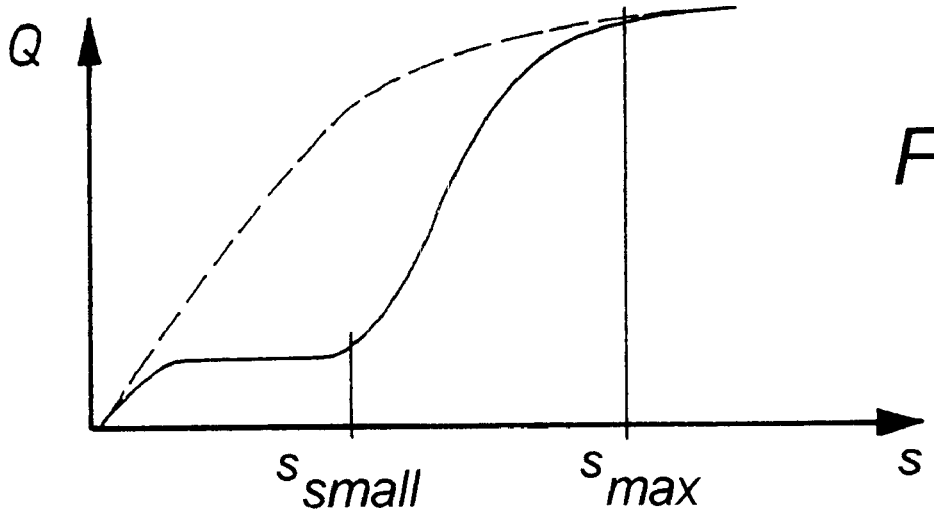
FIG. 2 shows the course of the through flow curve through a control valve of a control unit according to the invention.

In FIG. 1, the small strokes are labeled $s_{small}$. In FIG. 2, the course of the through flow curve Q=f(s) is plotted as a function of the stroke s of the control valve 1. The through flow curve of the control valve 1 of the control unit according to the invention is shown with a solid line, while the course of the through flow curve Q through the control valve of a control unit according to the prior art is shown with a dashed line. FIG. 2 clearly shows that with small strokes $s_{small}$, the through flow quantity Q through the control valve 1 in the control unit according to the invention has a very flat, virtually constant course. This has the advantage that in the control unit according to the invention, with small strokes $s_{small}$, the through flow quantity Q through the control valve 1 does not depend on the magnitude of the stroke s of the control valve 1 as is the case in the control unit according to the prior art. With greater strokes between $s_{small}$ and $s_{max}$, the through flow quantity climbs rapidly to a value which is also achieved by the control units known from the prior art. The very steep climb between $s_{small}$ and $s_{max}$ is produced as a result of the flat course of the additional valve seat 10 (see FIG. 1).

In FIGS. 1 and 2, the small strokes are labeled $s_{small}$. In FIG. 3, the course of the through flow curve Q=f(s) is plotted as a function of the stroke s of the control valve 1. The through flow curve of the control valve 1 of the control unit according to the invention is shown with a solid line, while the course of the through flow curve Q through the control valve of a control unit according to the prior art is shown with a dashed line. FIG. 3 clearly shows that with small strokes $s_{small}$, the through flow quantity Q through the control valve 1 in the control unit according to the invention has a very flat, virtually constant course. This has the advantage that in the control unit according to the invention, with small strokes $s_{small}$, the through flow quantity Q through the control valve 1 does not depend on the magnitude of the stroke s of the control valve 1 as is the case in the control unit according to the prior art. With greater strokes between $s_{small}$ and $s_{max}$, the through flow quantity climbs rapidly to a value which is also achieved by the control units known from the prior art. The very steep climb between $s_{small}$ and $s_{max}$ is produced as a result of the flat course of the additional valve seat 10 (see FIG. 1).

The foregoing relates to a preferred exemplary embodiments of the invention, it being understood that other variants and embodiments thereof are possible within the spirit and scope of the invention, the latter being defined by the appended claims.

I claim:

1. A control unit for controlling a pressure buildup by a pump unit in a fuel injection system, in which the control unit includes a control valve (1) and a valve actuation unit connected to the control valve (1) in order to selectively actuate the control valve (1), the control valve (1) has a first valve body (3) disposed between an inlet (8) and an outlet (9) of the control valve (1) and supported within a housing (2) of the control unit so that the first valve body moves axially in the housing (2), the first valve body (3) controls a flow through the control valve (1) in a direction (14) from the inlet (8) to the outlet (9), the control valve (1) is embodied as an inlet valve with the first valve body (3) that rests on a valve seat (4) of the control valve (1) from an inside of the control valve (1) when the control valve (1) is closed to prevent any flow through the control valve (1) and opens in a direction approximately opposite to the flow direction (14), the control valve (1) further has a throttle device (5) disposed between the inlet (8) and the outlet (9) and making part of the first valve body (3), the throttle device (5) throttles the flow through the control valve (1) when the control valve (1) is opened by a small stroke ($s_{small}$) and allows an unrestricted flow through the control valve (1) when the first valve body (3) is opened beyond the small stroke ($s_{small}$), the throttle device (5) includes a second valve body (6) which is disposed between the first valve body (3) and the outlet (9), the second valve body (6) has at least one throttle bore (7) which communicates with the inlet (8) and the outlet (9) when the control valve (1) is open by the small stroke ($s_{small}$) and allows an unrestricted air flow through the control valve (1) when the first valve body (3) is opened beyond the small stroke ($s_{small}$), the second valve body (6) is supported within the first valve body (3) so that the second valve body (6) moves axially in the first valve body (3) and the second valve body (6) rests on a second valve seat (10) of the control valve (1) from the inside of the control valve (1) as long as the stroke (s) by which the first valve body (3) is opened does not go beyond the small stroke ($s_{small}$).

2. The control unit according to claim 1, in which a spring element (11) acts between the first valve body (3) and the second valve body (6) and presses the second valve body (6) against the second valve seat (10) as long as the stroke (s) by which the first valve body (3) is opened does not go beyond the small stroke ($s_{small}$).

3. The control unit according to claim 2, in which the second valve body (6) has a stop shoulder (12) which rests on the first valve body (3) if the stroke (s) by which the first valve body (3) is opened goes beyond the small stroke ($s_{small}$).

4. An injection system including a control unit as set forth in claim 3, for fuel delivery into a combustion chamber of a direct injection internal combustion engine, the injection system comprising a pump unit for building up an injection pressure and a fuel injector for injecting the fuel into the combustion chamber with the injection pressure.

5. A process for controlling a pressure buildup by a pump unit in a fuel injection system by means of a control unit, which comprises connecting a control valve (1) embodied as an inlet valve with a first valve body (3) resting on a valve seat (4) of the control valve (1) from an inside of the control valve (1) when the control valve (1) is closed to prevent any flow through the control valve (1) and opening in a direction approximately opposite to a flow direction (14) through the control valve (1) from an inlet (8) to an outlet (9) of the control valve (1), to a valve actuation unit;

supporting the first valve body (3) within a housing (2) of the control unit so that the first valve body (3) moves axially in the housing (2) and rests on a valve seat (4) of the control valve (1) from the inside of the control valve (1) when the control valve (1) is closed;

controlling a stroke (s), by which the first valve body (3) is opened, from a position in which the valve body (3) is opened by a large stroke ($s>s_{small}$), through a position in which the valve body (3) is open by a small stroke ($s_{small}$) and into a closed position in order to build up a pressure in the injection system;

throttling a flow through the control valve (1) by means of a throttle device (5) disposed between the inlet (8) and the outlet (9) as long as the stroke (s) does not go beyond the small stroke ($s_{small}$); and controlling the fuel delivery by a pump unit for building up an injection pressure and then for injecting the fuel into the combustion chamber of a direct injection internal combustion engine via a fuel injector.

* * * * *